US007625177B2

(12) United States Patent
Ivakitch

(10) Patent No.: US 7,625,177 B2
(45) Date of Patent: Dec. 1, 2009

(54) SIMPLE AXIAL RETENTION FEATURE FOR ABRADABLE MEMBERS

(75) Inventor: Richard Ivakitch, Toronto (CA)

(73) Assignee: Pratt & Whitney Canada Cororation, Longueuil, Quebec (CA)

( * ) Notice: Subject to any disclaimer, the term of this patent is extended or adjusted under 35 U.S.C. 154(b) by 471 days.

(21) Appl. No.: 11/513,022

(22) Filed: Aug. 31, 2006

(65) Prior Publication Data

US 2008/0056890 A1 Mar. 6, 2008

(51) Int. Cl.
*F01D 11/00* (2006.01)

(52) U.S. Cl. ..... 415/173.4; 415/174.4; 415/174.5

(58) Field of Classification Search ..... 415/173.4, 415/174.4, 174.5; 277/303, 415
See application file for complete search history.

(56) References Cited

U.S. PATENT DOCUMENTS

| | | | | | |
|---|---|---|---|---|---|
| 1,857,961 | A * | 5/1932 | Lamb | 277/413 |
| 3,146,992 | A * | 9/1964 | Farrell | 415/12 |
| 3,728,039 | A * | 4/1973 | Plemmons et al. | 415/115 |
| 4,909,706 | A * | 3/1990 | Bergsten et al. | 415/172.1 |
| 5,967,746 | A * | 10/1999 | Hagi et al. | 415/174.4 |
| 6,039,535 | A * | 3/2000 | Kobayashi et al. | 415/172.1 |
| 6,547,522 | B2 * | 4/2003 | Turnquist et al. | 415/173.3 |
| 6,733,235 | B2 * | 5/2004 | Alford et al. | 415/173.1 |
| 7,025,356 | B1 * | 4/2006 | Cheung et al. | 277/415 |

* cited by examiner

*Primary Examiner*—Igor Kershteyn
(74) *Attorney, Agent, or Firm*—Ogilvy Renault

(57) ABSTRACT

An abradable member, such as gas turbine engine seal for rotary components, is restrained against axial movement relative to an adjacent component via a lip retention engagement.

18 Claims, 3 Drawing Sheets

SIMPLE AXIAL RETENTION FEATURE FOR ABRADABLE MEMBERS

TECHNICAL FIELD

The invention relates generally to abradable members and, more particularly, to an axial retention feature suited for abradable seals.

BACKGROUND OF THE ART

In gas turbine engines, seals are provided between components to prevent either air leakage, such as between the tips of the blades and the case (outer air seals), and between the vanes and the disks (knife edge seals), or air-oil leakage, such as rotating shaft seals. The efficiency of a gas turbine engine is dependent, at least in part, upon avoidance of leakage between rotating and stationary members or between two rotating members. During operation of the gas turbine engine, seals, either rotary seals or stationary seals, tend to slide axially, i.e. parallel to the gas turbine engine components they are sealing together. These axial displacements can reduce significantly the sealing capability and the ingested particles can damage bearings, gears, and/or other components adjacent to such seal if these components ingest the particles.

Accordingly, there is a need to provide an improved seal design which restrains axial displacement.

SUMMARY OF THE INVENTION

It is therefore an object of this invention to provide abradable seals having an axial retention feature to restrain axial displacement.

In one aspect, the present invention provides an abradable seal in combination with a first gas turbine engine component. The abradable seal comprises a seal body having one of a male member and a female member. The first gas turbine engine component comprises the other one of the male member and the female member. The male member and the female member are at least partially engaged into one another to axially restrain the seal.

In a second aspect, the present invention provides an abradable seal for sealing a channel defined between two gas turbine engine components. The abradable seal comprises: a seal body having an axial retainer, the axial retainer being one of a male member protruding outwardly and a female member defined therein and being at least partly engageable in the other one of the male member and female member provided on one of the gas turbine engine components, when the seal body is mounted thereto.

In a third aspect, the present invention provides a method for restraining axial displacement of a seal relatively to a juxtaposed gas turbine engine component. The method comprises the steps of: providing an axial retention member in a seal body, the axial retention member being one of a male member protruding radially outwardly and a female member defined therein; and mounting the seal body to the gas turbine engine component with the axial retention member engaged with the other one of the male member and the female member provided in the gas turbine engine component.

In a fourth aspect, the present invention provides an abradable sleeve mounting arrangement for a rotating component, comprising a first tubular component having an inner surface circumscribing a sleeve reception aperture defined along a rotation axis of the rotating component, an abradable sleeve positioned and retained within the sleeve reception aperture, said abradable sleeve defining a passage for receiving the rotating component, the abradable sleeve having at one location along an outer surface thereof one of a male member and a female member for mating engagement with another one of said female and male members on said inner surface of said first tubular component, thereby restraining relative axial movement between said abradable sleeve and said first tubular component.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
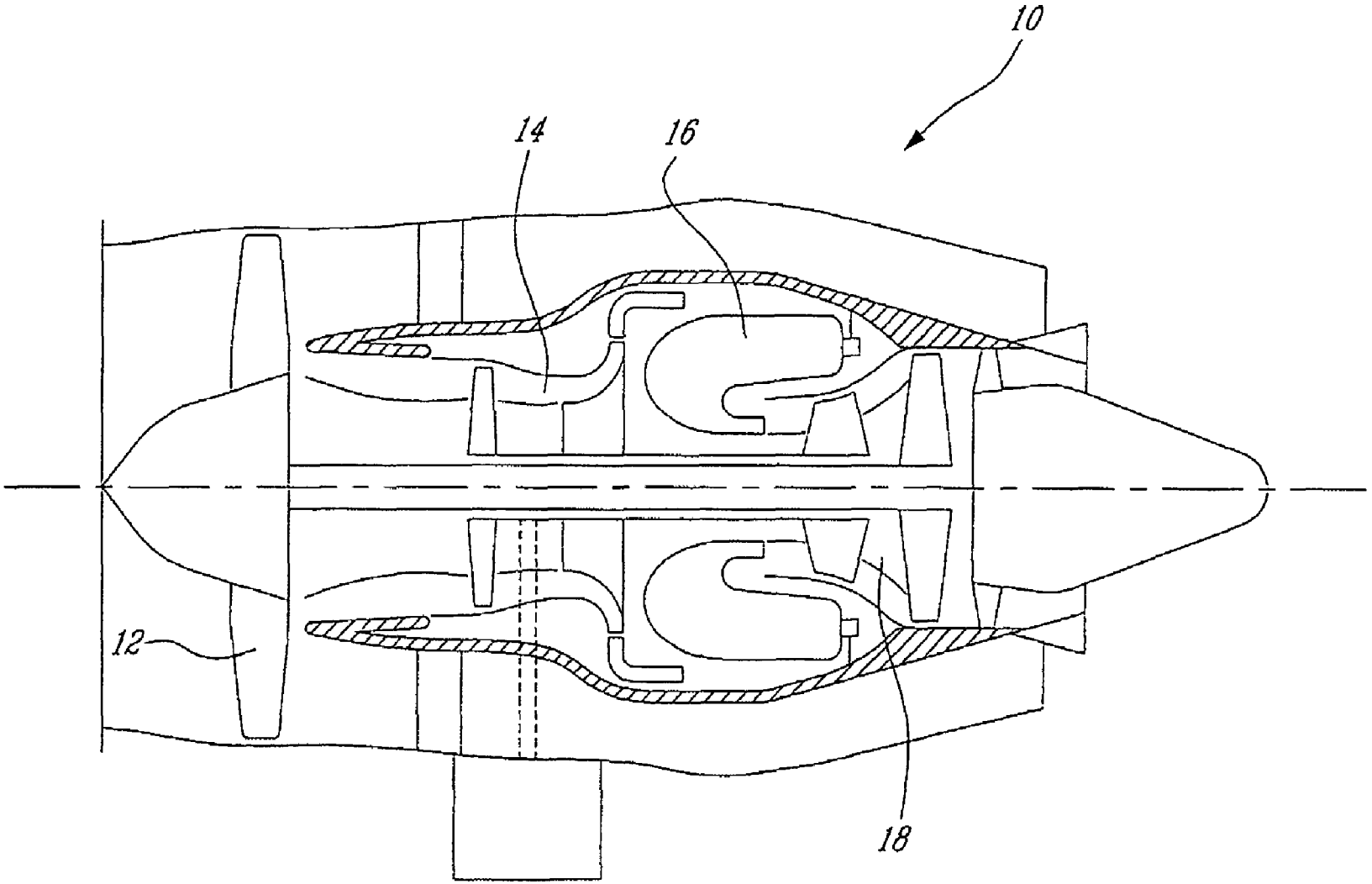
FIG. 1 is a schematic side view of a gas turbine engine, showing an example of a gas turbine engine in which abradable seals can be used.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
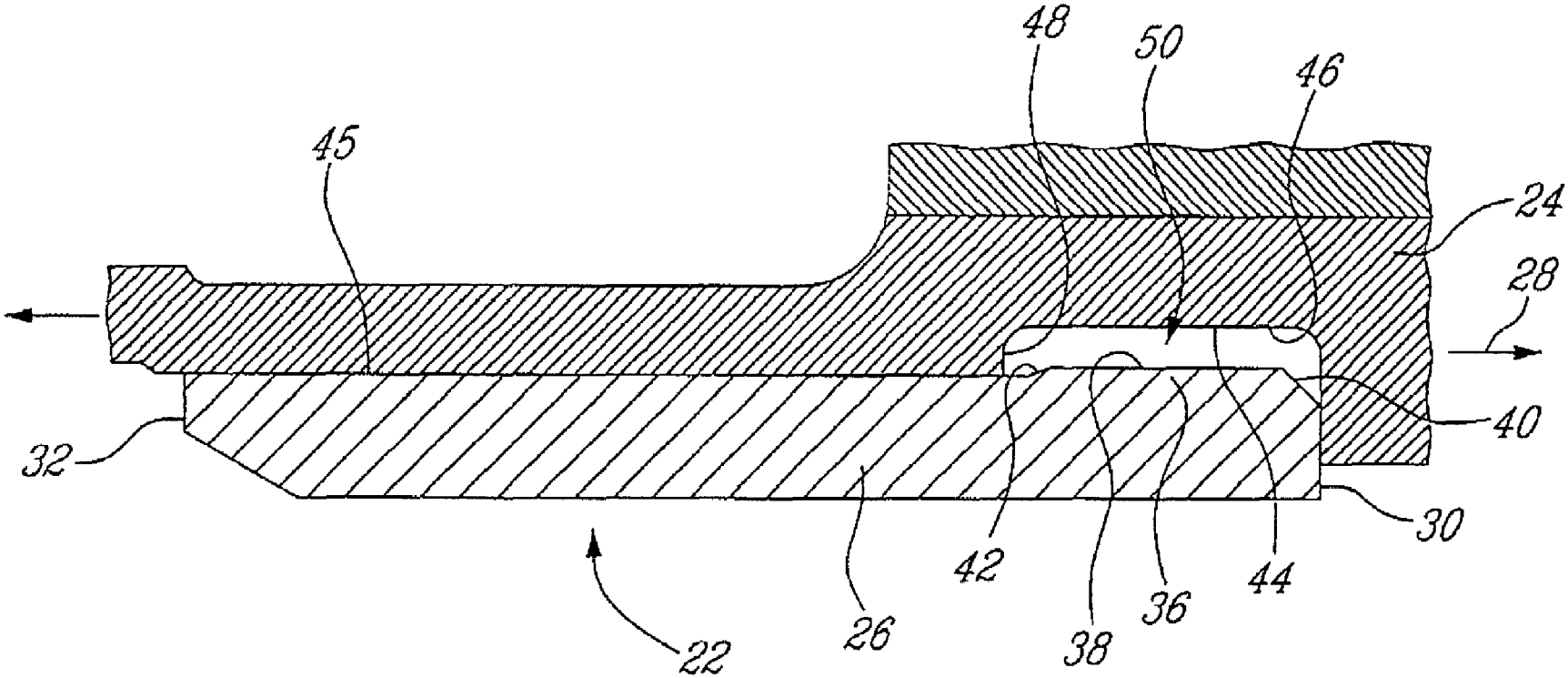
FIG. 2 is a cross-sectional view of an upper half portion of an annular abradable seal runner axially retained in a housing by means of a groove and lip engagement in accordance with an embodiment of the invention.

Abradable seals are extensively used between stationary and moving engine components to prevent, amongst other, fluid leakage. FIG. 2 shows an abradable seal 22 mounted to an engine component 24, which can be either a rotating or a stationary component. The seal 22 has a seal body 26 with a longitudinal axis 28, a front end 30, and a rear end 32. The seal body 26 has an axial retainer provided in the form of a lip 36, or male member, protruding outwardly from an outer surface 45, proximate to the front or leading end 30 of the seal body 26.

The lip 36 has a length l1, a height h1, an upper wall 38, substantially parallel to the longitudinal axis 28, a front wall 40, and a rear wall 42. The front and the rear walls 40, 42 define acute angles with the longitudinal axis 28, as it will be described in more details below.

When mounted to the gas turbine engine 10, the seal 22 is inserted between two gas turbine engine components 24 (only one is shown) to provide sealing therebetween. The gas turbine engine component 24 on which the seal 22 is mounted has an engaging recess 44, or female member, defined therein to receive the outwardly protruding lip 36 of the seal 22 therein and restrain axial displacement of the seal 36 relatively to the gas turbine engine component 24.

The engaging recess 44 has a length lg and a depth dg designed to receive, at least partially, the lip 44 therein. The engaging recess 44 is defined by a bottom wall 46 surrounded by a peripheral wall 48.

As shown in FIG. 2, when the seal 22 is mounted to the gas turbine engine component 24, the seal body peripheral wall 45 is juxtaposed to the gas turbine engine component 24 and the lip 36 is engaged in the recess 44.

In the embodiment shown, the length l1 of the lip 36 is shorter than the length lg of the recess 44 and the height h1 of the lip 36 is shorter than the depth dg of the recess 44 thereby allowing the lip 36 to be fully inserted in the recess 44. An internal cavity 50 is defined between the upper wall 38 of the lip 36 and the bottom wall 46 of the recess 44 since the depth dg of the recess 44 is deeper than the height h1 of the lip 36.

The internal cavity 50 can be at least partially filled with an adhesive as it will be described in more details below.

When the seal 22 tends to slide axially relatively to the gas turbine engine component 24, either frontwardly or rearwardly, either the front lateral wall 40 and the rear lateral wall 42 of the lip 36 abuts the peripheral wall 48 of the engaging recess 44, preventing the seal 22 to be further axially displaced.

In an embodiment, the seal 22 can be mounted between the two gas turbine engine components 24 by sliding the seal 22 along the longitudinal axis 28 between the pre-assembled gas turbine engine components 24. The acute angles defined between the longitudinal axis 28 and the front and rear lateral walls 40, 42 of the lip 36 facilitate the insertion of the seal 22 between both gas turbine engine components 24.

As mentioned above, an adhesive can be applied between the seal 22 and the gas turbine engine component 24, to which the seal 22 is mounted to, to further restrain the axial displacement of the seal 22. The adhesive can be applied either to the seal 22 or to the gas turbine engine component 24, to which the seal 22 is mounted to, before their juxtaposition. The adhesive can be applied solely in the recess 44 or over the lip 36. If an internal cavity 50 is defined between the upper wall 38 of the lip 36 and the bottom wall 46 of the recess 44, as in the embodiment shown in FIG. 2, the cavity can be thus at least partially filled with the adhesive.

Figure 3:
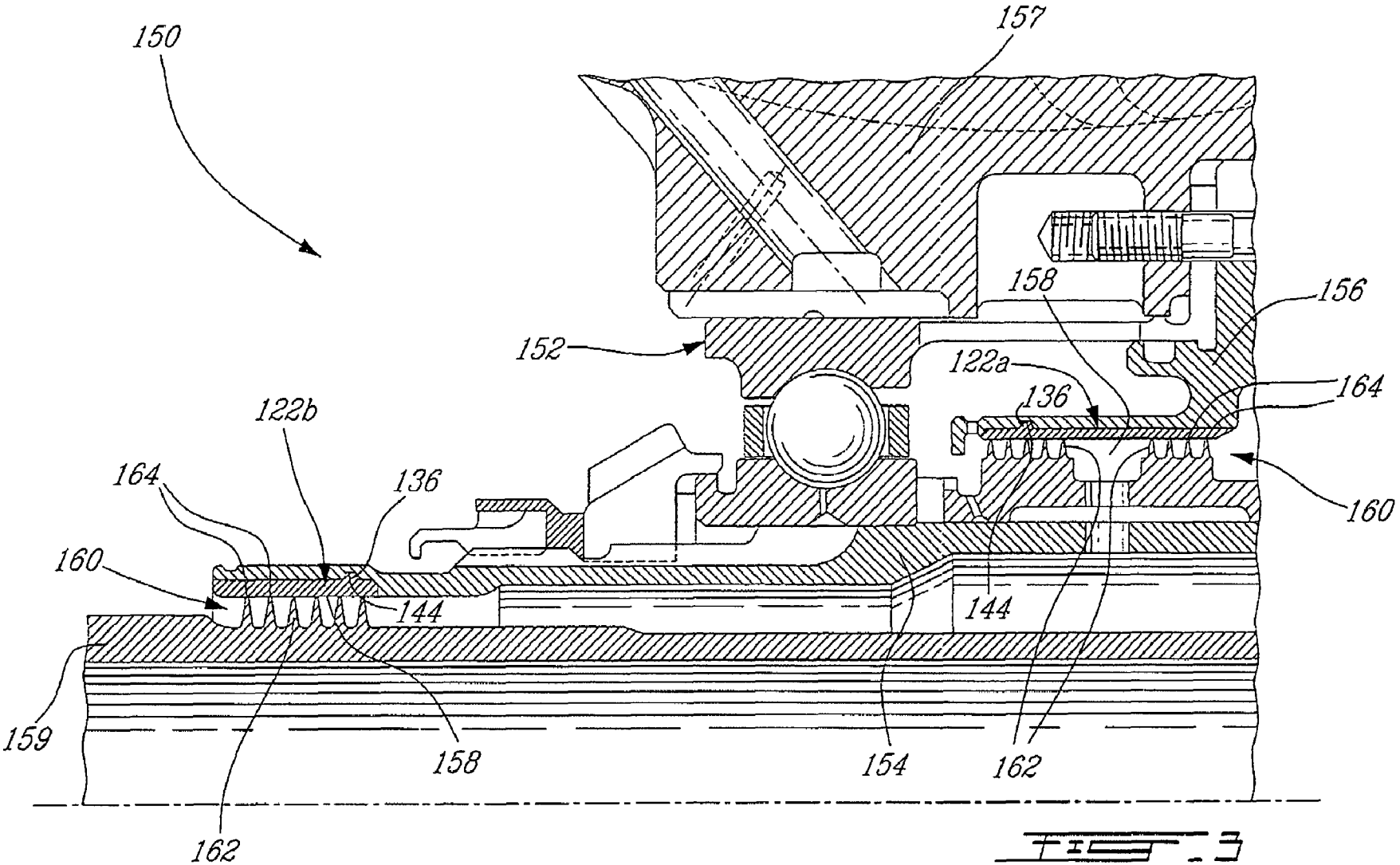
FIG. 3 is a cross-sectional view of a shaft bearing assembly having two abradable seals.

FIG. 3 shows two seal runners including an axial retention feature. In FIG. 3, the features are numbered with reference numerals in the 100 series which correspond with the reference numerals of FIG. 2. As will be seen herein below, the seal runner 122*a* is mounted to a stationary (or static) gas turbine engine casing component while seal runner 122*b* is mounted to a rotary part.

More particularly, FIG. 3 shows a shaft bearing assembly 150 which includes at least one bearing 152 mounted in a bearing housing 157 for supporting a rotating shaft 154. The bearing assembly 150 comprises a first seal arrangement composed of an annular abradable seal runner 122*a* and a labyrinth seal member 160 cooperating together to seal a channel 158 between the rotating shaft 154 and a housing component 156 forming part of the bearing housing 157. The seal runner 122*a* is mounted to the housing component 156 so as to tightly surround the labyrinth seal member 160, which is, in turn, mounted to rotating shaft 154. The housing component 156 defines an axially extending reception aperture coaxial to a central rotation axis of the engine for receiving the seal runner 122*a*. The seal runner 112*a* has a circumferential lip 136 at a leading end thereof for engagement in a corresponding groove 144 defined in the inner surface of the housing component 156 bounding the runner reception aperture thereof. The engagement of the lip 136 in the groove 144 restrains axial movement of the runner 122*a* relative to the housing component 156. The abradable runner seal 122*a* can be molded or otherwise formed directly in the housing component 156. The runner seal 156 could also be sufficiently flexible for allowing the insertion thereof into locking engagement within the housing component 156. Alternatively, the housing component 156 could be split in two halves and assembled about the seal runner 122*a*.

A second seal runner 122*b* is provided between the rotating shaft 154 and a second rotating shaft 159 disposed concentrically within the rotating shaft 154. As for the seal runner 122*a*, the seal runner 122*b* has a circumferential lip 136 protruding outwardly from a leading end portion thereof. The runner 122*b* is tightly fitted in the front end of rotating shaft 154. An engaging circumferential recess or groove 144 is defined in the rotating shaft 154 for captively receiving the lip 136 of the seal runner 122*b*. As for the seal runner 122*a*, the engagement of the lip 136 within the engaging recess 144 restrains axial displacement of the seal runner 122*b*.

The front and rear labyrinth seal members 160 juxtaposed to the front and rear seal runners 122*b* and 122*a* have a plurality of knife edges 162. The labyrinth seal members 160 rotate with shafts 154 and 159. Tips 164 of the knife edges 162 are disposed adjacent to the runners 122*a* and 122 in very tight clearance thereto such that a substructure fluid seal is provided therebetween. Although generally, as for the seal runner 122*a*, the knife edges 162 are disposed on a shaft 154 which rotates within a stationary surrounding seal runner 122*a*, it is to be understood that the converse is also possible, namely that the seal runner 122*a* rotates and the knife edges 162 of the labyrinth seal member 160 disposed in close juxtaposition thereto remains stationary. Further, as depicted for the seal runner 122*b*, both portions of the seal arrangement, i.e. the runner seal 122*b* and labyrinth seal member 160, may be rotating.

Even if in the embodiment described above, the runner seals 122*a*, 122*b* are used in combinations with labyrinth seal members 160, it will be appreciated that they could be used alone or with other structures.

The annular shape seals 122*a*, 122*b* can be of unitary construction or can include a plurality of seal bodies juxtaposed to one another and defining the continuous annular shaped seals 122*a*, 122*b*.

When the seal 22, 122 is annular shaped, it is appreciated that the axial retainer can be located either inwardly or outwardly of the closed figure defined by the seal 22, 122. The axial retainer is located inwardly if the seal 22, 122 is mounted to the gas turbine engine component which is mounted into the cavity and rotates therein. On the opposite, the axial retainer is located outwardly if the seal 22, 122 is mounted to the gas turbine engine component which defines the cavity.

The seal 22, 122*a*, 122*b*, including the lip 36, 136, can be made of any appropriate material. For example, without being limitative, the seal 22, 122*a*, 122*b* can be an insert made of reinforced composite thermal plastic material which is bonded or otherwise affixed to gas turbine engine components 24, 154, 156, 159. The reinforced composite thermal plastic used can include polyetheretherketone, polyetherimide, polyphenylene sulfide, and polyetherketoneketone, for instance. It can also be made of metallic abradable seal materials and other non-metallic polymer abradable materials, such as Teflon™ or thermoset plastics (see U.S. Pat. No. 4,460,185). The seal 22, 122*a*, 122*b* can be composed of a single material, or may be a composite material, or may include layers of different materials.

In the embodiments described above, the seal 22, 122 includes an axial retainer which is a male member protruding outwardly, i.e. the lip 36, 136, and the gas turbine engine component 24, 154, 156 includes the corresponding female member, i.e. the engaging recess 44, 144. However, in an alternate embodiment, the axial retainer of the seal 22, 122 can be a female member defined therein, such as, without being limitative, an engaging recess. In that embodiment, the gas turbine engine component 24, 154, 156 includes the corresponding male member, such as a male member protruding outwardly and adapted to be inserted in the female member defined in the seal 22, 122.

It will be appreciated that even if the lip 36, 136 protrudes outwardly proximate to one of the seal body ends 30, 32, the lip 36, 136 can protrude outwardly anywhere along the seal body length. Moreover, the shape of the axial retainer can vary from the shape of the lips 36, 136 shown in the above described embodiments. It will be appreciated that the shape of the corresponding engaging member provided in the gas turbine engine component varies accordingly.

The above description is meant to be exemplary only, and one skilled in the art will recognize that changes may be made to the embodiments described without department from the scope of the invention disclosed. For example, although the present invention is described in reference to its use in a gas turbine engine, it is to be understood that the axial retention feature of the present invention may be used in any other applications in which there is a need to provide a seal about a rotating gas turbine engine component, such as in pump, compressors and the like. Moreover, the shape of the axial retention feature, i.e. either the male or the female members, can vary from the ones described above in reference to FIGS. 1-3. Also the present axial retention feature could be applied to bumper sleeves mounted between concentric rotating shafts or abradable rings encircling bladed rotors. Still other modifications which fall within the scope of the present invention will be apparent to those skilled in the art, in light of a review of this disclosure, and such modifications are intended to fall within the appended claims.

What is claimed is:

1. An abradable seal in combination with a first gas turbine engine component, the abradable seal comprising: a seal body provided in the form of a one piece sleeve having one of a male member and a female member defined on an outer surface thereof; and the first gas turbine engine component have a one piece annular body defining an axially extending bore circumscribed by a bore inner surface, the seal body being axially inserted in tight fit engagement in the axially extending bore, the bore inner surface comprising the other one of the male member and the female member, the male member and the female member being at least partially engaged into one another to axially restrain the seal relative to the first gas turbine engine component in a direction opposite to an insertion direction of the seal body in the first gas turbine engine component.

2. A combination as claimed in claim 1, wherein the one of the male member and the female member of the seal body extends outwardly of an annulus defined by the abradable seal.

3. A combination as claimed in claim 1, wherein the seal body comprises the male member protruding outwardly therefrom and the first gas turbine engine component comprises the corresponding female member at least partly engaged into the male member.

4. A combination as claimed in claim 1, comprising a second gas turbine engine component juxtaposed to the first gas turbine engine component and defining therebetween a channel, at least one of the first gas turbine engine component and the second gas turbine engine component being a rotating gas turbine engine component, and the seal member being inserted between the first gas turbine engine component and the second gas turbine engine component and sealing the channel.

5. A combination as claimed in claim 4, wherein the rotating gas turbine engine component is a rotating shaft.

6. A combination as claimed in claim 1, wherein the male member has a height and the female member is deeper than the height of the male member defining therebetween an internal space.

7. A combination as claimed in claim 6, comprising an adhesive at least partially filing the internal space.

8. An abradable seal for sealing a channel defined between two gas turbine engine components, the abradable seal comprising: an annular seal body having an axial retainer, the annular seal body being of unitary construction, the axial retainer being one of a male member protruding radially outwardly and a female member defined therein and being at least partly engageable in the other one of the male member and female member provided on one of the gas turbine engine components, when the seal body is mounted thereto, wherein the annular seal body is axially slidably engaged with the one of the gas turbine engine components, the engagement of the male member in the female member restraining axial withdrawl of the adradable seal from the one of the gas turbine engine components in both axial directions.

9. An abradable seal as claimed in claim 8, wherein a first one of the gas turbine engine components has a cavity defined therein, a second one of the gas turbine engine components is mounted into the cavity, the abradable seal being annular shaped and circumscribing the second one of the gas turbine engine components, and one of the gas turbine engine components being a rotating gas turbine engine component.

10. An abradable seal as claimed in claim 9, wherein the axial retainer extends outwardly of the annulus defined by the abradable seal.

11. An abradable seal as claimed in claim 8, wherein the seal body comprises the male member and the one of the gas turbine engine components comprises the corresponding female member in which the male member is at least partly engageable.

12. An abradable seal as claimed in claim 8, wherein at least one of the gas turbine engine components is a rotating gas turbine engine component.

13. A method for restraining axial displacement of a seal relatively to a juxtaposed gas turbine engine component, the method comprising the steps of:

providing an axial retention member in a one-piece annular seal body, the axial retention member being one of a male member protruding outwardly and a female member defined therein; and axially sliding the one-piece annular seal body in tight fit engagement with the gas turbine engine component until the axial retention member engaged with the other one of the male member and the female member provided in the gas turbine engine component, the male member and the female member cooperating to restrain movement of the one-piece annular seal body relative to the gas turbine engine component in both axial directions.

14. The method as defined in claim 13, further comprising creating the female member in the gas turbine engine component.

15. The method as defined in claim 13, further comprising applying an adhesive to at least one of the male member and the female member before mounting the seal to the gas turbine engine component.

16. The method as defined in claim 13, further comprising creating slopes in a peripheral wall of the male member.

17. An abradable sleeve mounting arrangement for a rotating component, comprising a first one-piece tubular component having an inner surface circumscribing a sleeve reception aperture defined along a rotation axis of the rotating component, an abradable sleeve of unitary constructions positioned and retained within the sleeve reception aperture, said abradable sleeve defining a passage for receiving the rotating component, the abradable sleeve having a seal body being axially inserted in tight fit engagement in the sleeve reception and having at one location along an outer surface thereof one of a male member and a female member for mating engagement with another one of said female and male members on said inner surface of said first tubular component, the female member and the male member cooperating to restrain relative axial movement between said abradable sleeve and said first tubular component in both axial directions.

18. An abradable sleeve mounting arrangementas claimed in claim 17, wherein said abradable sleeve is a seal, and wherein said male member is a circumferentially extending lip provided on the outer surface of the seal.

* * * * *